US008132564B2

(12) United States Patent
Stone

(10) Patent No.: US 8,132,564 B2
(45) Date of Patent: Mar. 13, 2012

(54) PRESSURE BOTTLE FOR PAINTBALL MARKER

(75) Inventor: Mark W. Stone, Springboro, OH (US)

(73) Assignee: Gayston Corporation, Springboro, OH (US)

( * ) Notice: Subject to any disclaimer, the term of this patent is extended or adjusted under 35 U.S.C. 154(b) by 43 days.

(21) Appl. No.: 12/554,310

(22) Filed: Sep. 4, 2009

(65) Prior Publication Data

US 2011/0056472 A1 Mar. 10, 2011

(51) Int. Cl.
*F41B 11/00* (2006.01)

(52) U.S. Cl. ..... 124/74

(58) Field of Classification Search ..... 124/74
See application file for complete search history.

(56) References Cited

U.S. PATENT DOCUMENTS 5,348,059 A * 9/1994 Carroll ..... 141/21
6,047,727 A * 4/2000 Hatori et al. ..... 137/505.28
6,405,722 B2 * 6/2002 Colby ..... 124/74
6,539,969 B1 4/2003 Sullivan
6,851,447 B1 2/2005 Carroll
7,231,912 B2 * 6/2007 Stevens ..... 124/73
7,383,833 B2 * 6/2008 Stevens ..... 124/73
2006/0011183 A1 * 1/2006 Dziob ..... 124/71
2009/0078321 A1 * 3/2009 Arnott et al. ..... 137/14

OTHER PUBLICATIONS

International Search Report, Form PCT/ISA/210, mailing date of Jul. 18, 2008.

* cited by examiner

*Primary Examiner* — Troy Chambers
(74) *Attorney, Agent, or Firm* — Wood, Herron & Evans, LLP

(57) ABSTRACT

An apparatus [10] for use in paintball includes a modified pressure bottle [14, 114] with a valve assembly [34, 134] "integrally" mounted within the neck [16, 116] thereof, and independent of the connection structure [46/48, 116*a*] for connecting the bottle [14, 114] to a paintball marker [12, 112]. The structure prevents sudden and inadvertent venting to atmosphere of the pressurized gas held within the internal volume [29, 129] of the bottle [14, 114], thereby eliminating a dangerous situation that existed with prior conventional paintball devices.

12 Claims, 3 Drawing Sheets

PRESSURE BOTTLE FOR PAINTBALL MARKER

FIELD OF THE INVENTION

The present invention relates to pressure bottles, and more particularly, to a pressure bottle used in conjunction with a paintball gun (alternatively referred to as a "paintball marker").

BACKGROUND OF THE INVENTION

Generally, pressure vessels (ex: bottles, tanks, containers, cylinders) are manufactured to regulatory standards which require certain design criteria and qualification approvals, as well as on-going production inspection by independent inspection agencies. For this application, "pressure bottle" and "pressure vessel" are used interchangeably. Such agency oversight helps to assure that the applicable pressure vessels meet these safety and performance standards. However, there are currently no comparable regulatory standards for controlling the type of apparatus that may be subsequently attached or assembled to the pressure vessel, to fill the vessel and/or to control the flow and safe venting of its pressurized contents. Pin valves commonly used for this purpose can be fairly easily removed or tampered with. Also, such valves can be replaced by substitute valves which may not contain a burst disk or other features designed for the safe and reliable use of the pressure vessel. Also, replacement valves may be improperly installed or otherwise defective.

Such pressure vessels are commonly used with paintball markers, to supply controlled bursts of pressurized gas to propel the paintballs out of the marker barrel. The pressure bottles, which are refillable, vary in gas capacity depending on the number of shots the paintball player will take before having to again refill. Typical $CO_2$ bottle sizes range from 9 ozs to 24 ozs and are rated at 1800 psi, although they typically operate at about 850 psi. These $CO_2$ bottles represent the majority of paintball bottles currently in use.

In this context, it is typical for a standard pin valve to reside within a valve body, the valve body having a first end that threadably connects to the pressure bottle and a second end that threadably connects to the paintball marker. But this typical design presents safety problems, as described in an article published by the U.S. Consumer Product Safety Commission and entitled "CPSC issues New Safety Warning for Paintball Guns," which is expressly incorporated by reference herein, in its entirety.

More specifically, the use of two separate threadable connections at opposite ends of the same valve body creates an unacceptable risk of an accidental disconnection. Due to the pressure of the gas in the bottle, any sudden, accidental disconnection could result in a deadly projectile. With this type of structure, the repeated connection and disconnection of the marker to the valve body, via the threaded connection, can produce the unintended application of torque to the other threaded connection between the valve body and the pressure bottle. Moreover, this can occur on a repeated basis.

More specifically, the use of a pin valve housed within a valve body that directly threads into both the pressure bottle and the appliance (paintball gun or other gas powered device) can result in inadvertent removal of the pin valve from the pressurized bottle. This can occur in cases where the resistance to removal of the valve from the threaded appliance is greater than the resistance required to remove the pin valve from the pressure vessel. And this may occur for a number of different reasons, including the inadvertent cross threading of the valve to the appliance, or even the use of non-conforming threads in the appliance receiver, or incorrect installation of the pin valve to the pressure vessel, or the use of a non-conforming pin valve thread. Invariably, all of these situations eventually occur during periodic refilling of the pressure vessel.

In addition to this safety problem, this type of valve body is also relatively bulky and expensive, due to the need to provide two axially spaced threaded connections, to connect to two different structures. For paintball markers, this unnecessarily adds to the weight and bulk of the overall device.

It is an object of the present invention to improve the safety of pressure bottles used in conjunction with paintball markers, and to facilitate refilling of such pressure bottles in a manner which does not create a corresponding increase in safety risk.

It is another object of the present invention to simplify the connections between a pressure bottle and a paintball marker.

It is another object of the present invention to eliminate the susceptibility to sudden and inadvertent valve body removal from a pressure bottle, which may otherwise result from undesired torquing or loosening of the connection therebetween, when a user tries to disconnect the pressure bottle from the paintball marker.

It is still another object of the present invention to reduce the overall costs of the components that connect to a paintball marker.

It is still another object of the present invention to achieve these other objectives while still employing a structure which readily accommodates i.e., easily connects to and disconnects from, a standard paintball marker.

SUMMARY OF THE INVENTION

The present invention achieves these objectives via an improved pressure bottle that connects to the paintball marker via a first connection, preferably a set of threads, that is separate and independent from a second internal connection between the pressure bottle and the valve assembly. With separate connections, the pressure bottle can be connected to the paintball marker via the first connection, and disconnected therefrom via the first connection, without affecting the connection that holds the valve assembly to the pressure bottle. The pressure bottle includes a built in, or in some respects integral valve assembly, which resides within the neck of the pressure bottle. This isolates the valve assembly from the first connection, thereby allowing the safe control of the flow of stored pressurized gas (ex: $CO_2$) to and from the pressurized vessel.

In one embodiment, the first connection occurs via a direct threaded connection between the paintball marker and the outer surface of the neck of the bottle. In another embodiment, the first connection occurs between the paintball marker and the outer surface of one end of a bonnet, the bonnet also having an opposite end that connects inside the neck of the bottle. Each of these two preferred embodiments uses a threaded connection to connect to the paintball marker. Both embodiments eliminate the possibility of the valve assembly inadvertently or suddenly disconnecting from the pressurized bottle during removal of the bottle from the marker.

This invention greatly simplifies the valve operation and eliminates several costly valve parts. In one embodiment the valve stem assembly can be a commercially available high pressure valve stem which is threaded into the bottle neck and then retained by a threaded valve retainer.

The invention allows the bottle to be initially filled and re-filled with pressurized $CO_2$, to vent in cases of over pressurization, and to dispense pressurized $CO_2$ in the same manner as currently employed for the bottle/pin valve combination for conventional connection devices. But with this invention the risk associated with valve removal is eliminated, and this is done with significant cost savings in manufacture. Likewise, placement of the valve assembly within the neck of the bottle eliminates possible leaks and failures of separate external valve components. This integral structure also provides a more pleasing and compact styling to the consumer, due to reduced bulk and weight.

Because this present invention recesses the valve assembly within the neck of the pressure bottle, it prevents any rotational force from being exerted on the valve assembly, i.e. rotational force that might otherwise cause it to unscrew from the pressure vessel neck during removal of the pressure vessel from the appliance. Instead, a direct connection is made between the threaded receiver of the appliance (the paintball marker) and, in one case, the threaded neck of the pressure bottle, and in another case, the threaded neck of the bonnet. In both cases, this first connection is independent from, and thereby does not affect the structure that connects the valve assembly to the bottle.

According to one preferred embodiment of the invention, an adaptor is threadably inserted within the pressure bottle neck, which in turn threadably receives a valve assembly, and then receives an inserted retainer, which prevents removal of the valve. That is, the valve cannot be removed without significant and visual damage being done to the valve assembly.

According to another preferred embodiment, the valve assembly directly connects to the internal passage of the neck of the bottle, and a bonnet also connects to the neck of the bottle, with one internal end located adjacent to but not connected to the valve assembly and an outer end to which the paintball marker threadably connects.

Also, a burst disk is preferably located in a side port formed in the neck of the bottle. Previously, such a burst structure would be located in the external valve body. In effect, this invention modifies the structure of the bottle neck and eliminates the need for an external valve body.

These and other features of the invention will be more readily understood in view of the following detailed description and the drawings.

DETAILED DESCRIPTION OF THE DRAWINGS

This application claims priority to previously filed U.S. Provisional Application No. 60/894,705, entitled "Pressure Bottle With Integral Valve," filed on Mar. 14, 2007, which is expressly incorporated by reference herein, in its entirety.

Figure 1:
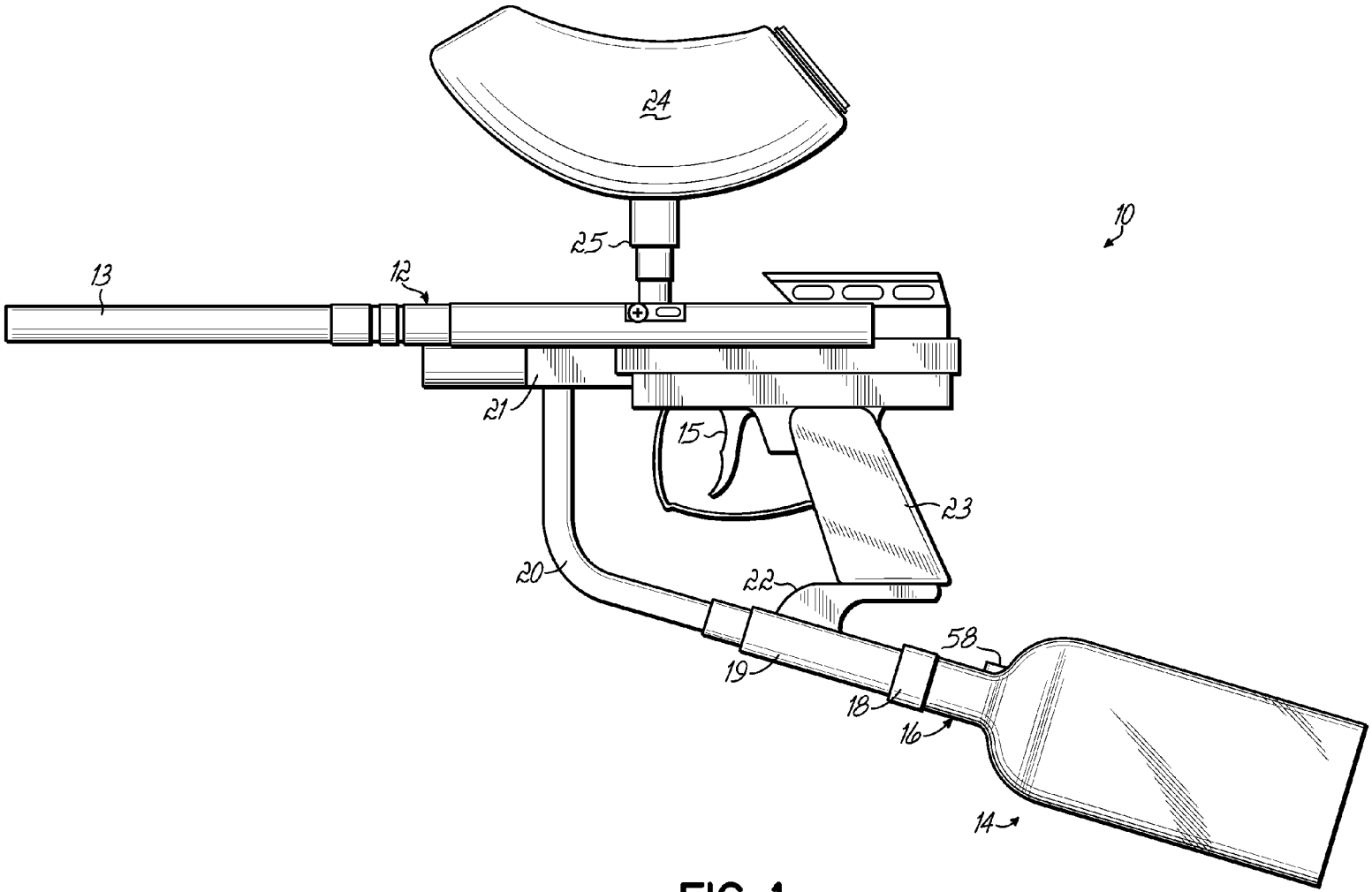
FIG. 1 is a side view of a paintball marker operatively connected to a pressure bottle, according to the invention.

FIG. 1 shows an apparatus 10 which, generally, is the subject of the present application, namely a paintball marker 12 connected to a pressure bottle 14. In practical terms, the paintball marker 12 is a paintball gun that fires paintball pellets outwardly from the barrel 13 when the user squeezes the trigger 15. The gun 12 shown in FIG. 1 is exemplary in nature, in that the principles of this invention primarily relate to the pressure bottle, or pressure vessel 14, and particularly the manner in which a conventional paintball marker 12 removably connects to the pressure bottle 14.

For a number of practical reasons, the present invention is most advantageously used with carbon dioxide ($CO_2$), in vessels 14 with a rated service pressure of about 1800 psi. Carbon dioxide is the most commonly used gas for paintball activities because it is readily available, has low cost, and can be stored in lower cost bottles with a rated service pressure of 1800 psi. Also, its outward flow and its safe use can be more readily controlled. Generally, a typical operating pressure for carbon dioxide at 70° Fahrenheit is about 850 psi, with elevated pressures occurring only at elevated temperatures, or due to overfilling of the pressure bottle 14.

As an alternative to carbon dioxide, the pressure bottle 14 could be filled with high pressure air or nitrogen, gases which do not exhibit excessive temperature/pressure sensitivity. In that case, the pressure bottle 14 should have a rated service pressure in the rang of about 3,000 to 5,000 psi, to maximize the amount of stored compressed gas. Nonetheless, such high pressure vessels are more expensive, and require the use of a regulator, to reduce the high pressure down to a usable delivery pressure.

As shown in FIG. 1, the bottle 14 resides generally below the marker 12. The pressure bottle 14 includes an elongated neck 16 at one end thereof. A sleeve 18 held by the gun 12 removably connects the pressure bottle 14 to the gun 12. When trigger 15 is squeezed, pressurized gas exits the pressure bottle 14 via an internal passage (not shown) located inside the neck 16, and it flows to the gun 12. This internal passage terminates at one end of the bottle 14, namely the upper end when the bottle 14 is standing upright. Sleeve 18 preferably includes internal threads and a gasket to create a fluid-tight connection between the pressure bottle 14 and the gun 12. Connecting the bottle 14 to the sleeve 18 aligns the bottle 14 with a conduit 19 that in turn connects to a tube 20 that connects to a body 21 of the gun 12. As shown in FIG. 1, the conduit 19 mounts to a bracket 22 that is secured to a lower end of a handle 23 of the gun 12. A magazine 24 removably connects to the top of the barrel 13 of the gun 12, and holds a supply of ammunition, namely paintball pellets, which are fed to the barrel 13 via an inlet 25.

From conduit 19 and tube 20, the pressurized gas flows into the body 21 of the gun 12, where it causes a paintball pellet to be forcibly expelled from the barrel 14. Thus, when trigger 15 is squeezed, there is an open fluid line from the bottle 14 to the gun 12. To create this open fluid line, the trigger 15 operatively connects to an internal mechanical actuator (not shown) which cooperates with a valve mechanism (not shown) associated with the bottle 14. The present invention does not specifically relate to the trigger 15 or the internal mechanical actuator of the paintball marker 12. Rather, the present invention relates to the bottle 14, and is designed to work with existing, conventional devices such as marker 12 that are already on the market. Stated more specifically, the present invention resides particularly in the structure that connects to a conventional paintball marker 12 via the sleeve 18, and which does so in a manner that significantly increases the safety of paintball activities.

More particularly, the present invention facilitates connection of the bottle 14 to the gun 12 for initial use of the apparatus 10, and subsequent disconnection of the bottle 14 from the gun 12 when it is necessary to refill the bottle 14 with pressurized gas. And the structure of the present invention enables disconnecting of the bottle 14 from the gun 12 to occur in a manner which negates any potentially dangerous condition caused by the pressurized contents of the bottle 14. The safety features of the present invention are described in more detail below, in the context of FIGS. 2 and 3.

Figure 2:
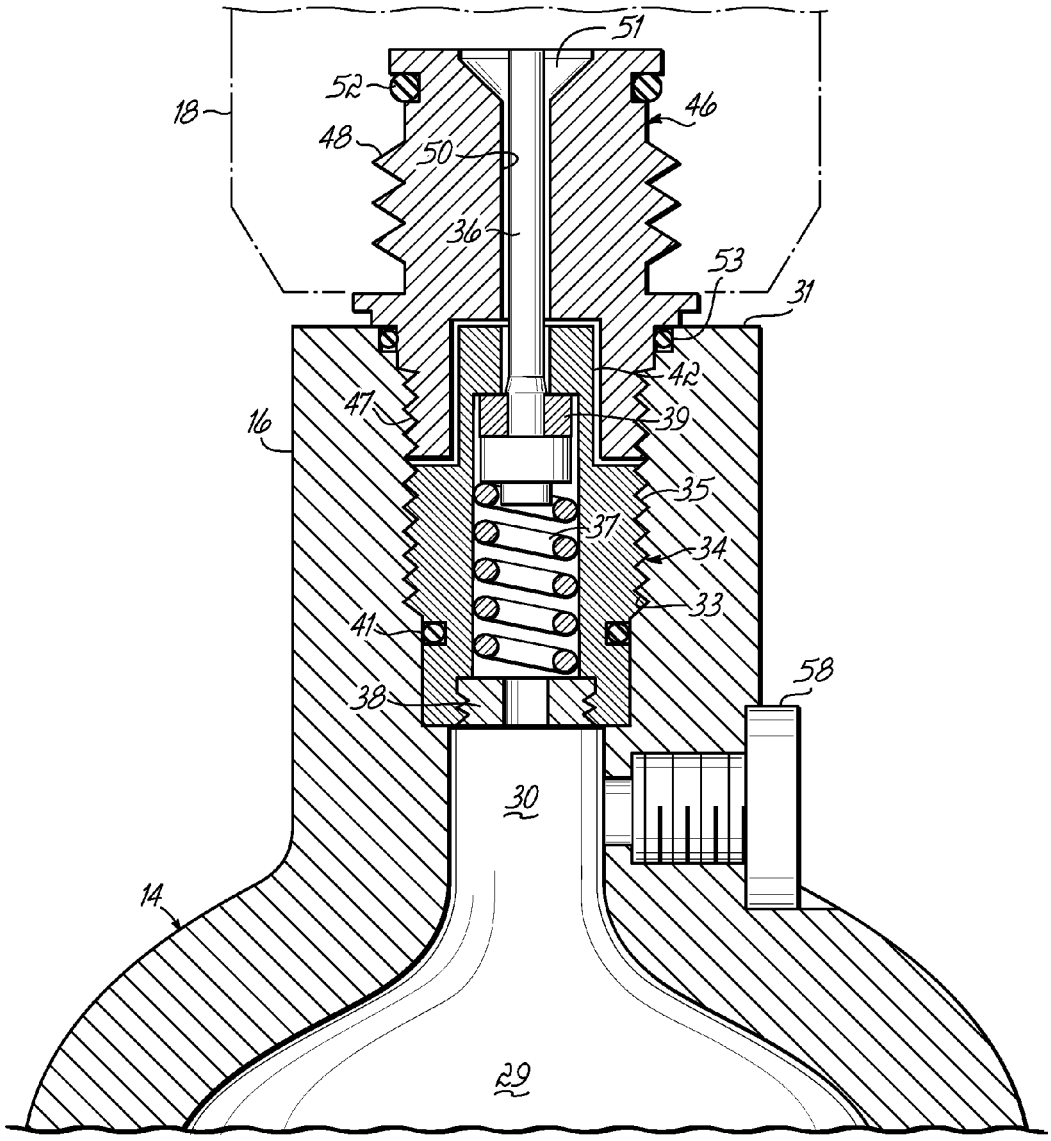
FIG. 2 is a longitudinal cross-sectional view of the neck end of a pressure bottle of the type shown in FIG. 1, according to a first preferred embodiment of the invention.

FIG. 2 shows a longitudinal cross-sectional view of a pressure bottle 14 according to a first preferred embodiment of the invention. The bottle 14 includes an internal volume 29 which includes an internal passage 30 located inside of the neck 16 of the bottle 14. The internal passage 30 extends to a first end 31 of the bottle 14. As shown in FIG. 2, with the bottle 14 in an upright position, first end 31 is the upper end of the bottle 14.

The bottle 14 includes internal threads 33 formed along the inside of internal passage 30. A valve core body 34 resides within the internal passage 30, and preferably connects thereto via external threads 35 which cooperatively engage internal threads 33. Thus, via the threaded connection of external threads 35 and internal threads 33, the valve core body 34 removably connects to the bottle 14 within internal passage 30.

The valve core body 34 is one component of a valve assembly that also includes a valve stem 36. The valve stem 36 is urged to an uppermost and closed position via an internal spring 37, which is in turn held in place via a retaining nut 38, which is received within an innermost end of the valve core body 34, preferably via a threaded connection. To some extent, and depending on the volume of pressurized gas remaining in the bottle 14, the remaining gas holds the valve stem 36 closed. The valve stem 36 acts against a annular puck 39, which fits over the valve stem 36 and acts as a seal when the valve stem 36 is held closed by the spring 37, i.e. urged in the direction away from the internal volume 29. The puck 39 is made of rubber or plastic of suitable Durometer. FIG. 2 also shows an O-ring 41 residing between the valve core body 34 and the neck 16.

Figure 2A:
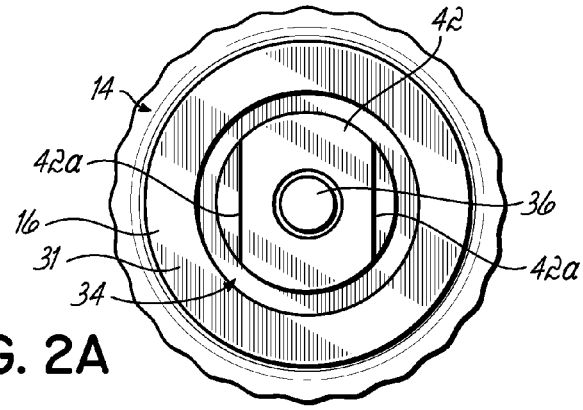
FIG. 2A is a transverse cross-sectional view of the valve assembly shown in FIG. 2, without the bonnet 46 in place.

An outermost end, or top end, 42 of the valve core body 34 has a size and shape that is configured to enable threadably removable of the valve core body 34 from the internal passage 30, if necessary. FIG. 2A shows an end view of this top end 42, and more particularly shows opposing flat surfaces 42*a* for engagement by an appropriate tool to threadably remove the valve core body 34 from the neck 16. But again, it is not expected that typical users will be removing the core body 34, but only manufacturers. In fact, core body 34 may be installed with a threadlocking compound, such as Loctite compound, to more securely hold it in place. Moreover, the top end 42 can be configured so that only a specialized tool can be used to remove the core body 34 from the bottle 14.

FIG. 2 also shows a bonnet 46 with one end that removably connects to the first end 31 of the bottle 14, within the passage 29 and preferably via a first set of external threads designated by reference numeral 47. The threads 47 threadably engage the internal threads 33 of the neck 16. The bonnet 46 also includes a second set of external threads, designated by reference numeral 48, which are sized and shaped differently from the first set of threads 47. The second set of external threads 48 is configured to threadably engage the paintball marker 12, preferably via the sleeve 18 shown in FIG. 1. When the bonnet 46 is connected to the bottle 14 in this manner, it also includes an internal channel 50 extending therethrough, and the upper end of the valve stein 36 extends through the internal channel 50 into an outer recess 51 formed in the bonnet 46. The space between the outer surface of the valve stem 36 and the channel 50 is annular in shape, and forms part of a fluid flow path through the internal passage 30 for the pressurized gas. The bonnet 46 includes a first or upper O-ring 52 to assure a sealed connection with the gun 12, and a second or lower O-ring 53 residing between the bonnet 46 and the neck 16, for sealed connection at the internal end. The bonnet 46 resides adjacent the valve core body 34, but is not connected thereto. In fact, there is preferably a horizontal clearance of at least about 10 thousandths of an inch between the bonnet 46 and the body core 34, and also a radial clearance of similar dimension. Thus, the bonnet 46 is rotatable relative to the core body 34. To date, applicant has made the bonnet out of brass. Nonetheless, to reduce costs it may be possible to make the bonnet 46 out of aluminum, perhaps with a lubricious coating applied thereto, or any other suitable material.

When the bottle 14 and bonnet 46 are connected to the paintball marker 12, upon squeezing the trigger 15 the actuation mechanism (not shown) of the gun 12 cooperates with an outer end of the valve stem 36 within the outer recess 51. This creates an open flow path from the internal volume 29 to the gun 12, through the center of the retaining nut 38 and the valve core body 34, around the valve stem 36 and the puck 39, and then along the angular volume residing between the outer end of the valve stem 36 and the channel 50 of the bonnet 46.

With this configuration, the valve assembly remains secured within the neck 16 of the bottle 14 during connection of the bottle 14 to the gun 12 and disconnection of the bottle 14 from the gun 12 via the external threads 48 of the bonnet 46. Even if the bonnet 46 were to unintentionally or inadvertently become unthreaded from the neck 16, via the first set of threads 47, that would not adversely effect the connection of the valve core body 34 within the internal passage 30. Stated another way, the bonnet 46 and the valve core body 34 independently connect to the neck 16 within the internal passage 30, such that removal of the bonnet 46, whether intentional or not, does not cause the valve assembly to become loosened or removed from the internal passage 30. Moreover, because the valve stem 36 is held by the spring 37 in a closed position, unless acted upon by an actuator (not shown) operatively connected to the trigger 15, even removal of the bonnet 46 from the bottle 14 cannot create a situation whereby pressurized gas from the bottle 14 becomes open to atmosphere. Thus, the present invention eliminates the previously described dangerous condition associated with prior paintball marker/pressure bottle assemblies, wherein sudden and inadvertent disconnection of the pressure bottle from the valve body has on several reported occasions caused the pressurized air in the bottle to become open to atmosphere, and thereby launched the bottle as a projectile.

In typical use, gun 12 will be removably connected to the bottle 14 via the external threads 48 of the bonnet 46, and the bonnet 46 and the valve core body 34 will remain threadably engaged with the internal passage 30 of the next 16. As stated above, they have no affect on the threaded connection of the valve core body 34 in the neck 16.

The bottle 14 also includes an opening in the lower end of the neck 16, which houses a burst disk assembly 58. The burst disk assembly 58 provides a path to safely discharge gas from the internal volume 29, if the bottle 14 becomes over pressurized beyond the rated pressure of the burst disk, which will be lower than the rated pressure of the bottle 14.

Figure 3:
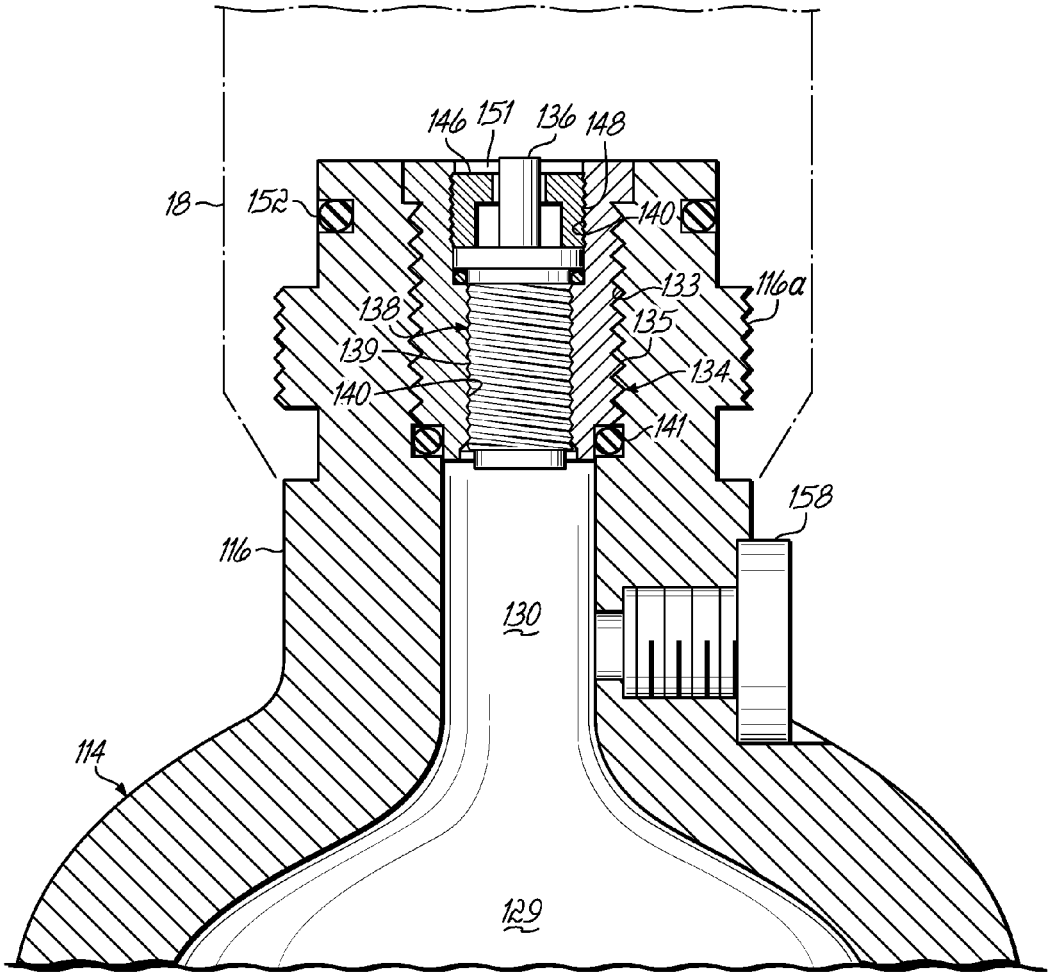
FIG. 3 is a longitudinal cross-sectional view of the neck end of a pressure bottle of the type shown in FIG. 1, similar to the pressure bottle shown in FIG. 2, but constructed according to a second preferred embodiment of the invention.

FIG. 3 shows a second preferred embodiment of the invention, which uses the same general principles of directly connecting a pressurized bottle 114 to the paintball marker 12 in a manner which does not enable the sudden and inadvertent venting of high pressure gas to atmosphere from a high pressure bottle. As with the first preferred embodiment shown in FIG. 2, the bottle 114 of FIG. 3 includes an internal volume 129 that also includes an internal passage 130 which extends along a neck 116. The internal passage 130 includes internal threads 133 which threadably cooperate with external threads 135 formed an annular adaptor 134. An O-ring resides 141 between the adaptor 134 and the neck 116. Preferably, the adaptor 134 also has a set of internal threads 140. A valve assembly 138 is held within adaptor 134, preferably via external threads 139 thereof which cooperate with the internal threads 140 of the adaptor 134. Preferably, the valve assembly 138 is secured with a threadlocking compound. Although the valve assembly 138 is removable from the bottle 14, it is intended to be removable by the manufacturer only. An annular retainer 146 connects to the adaptor 134 at a first end 131 of the bottle 114. Part of the valve assembly 138, namely a valve stem 136, extends upwardly through the retainer 146 into an open volume 157. Preferably, the retainer 146 connects to the adaptor 134 via a set of external threads 147 formed thereon which cooperate with a second set of internal threads 148 formed on the inside surface of adaptor 134. Although not specifically shown, the valve assembly 138 includes an internal spring which urges valve stem 136 toward an outermost position (or upper position, in FIG. 3), to close off fluid flow along a fluid path within the internal passage 130, defined by the various components residing therein.

As with the first embodiment shown in FIG. 2, when valve stem 136 is acted upon by the gun 12 to move toward the internal volume 139, against the spring force, pressurized gas escapes from the internal volume 129 along internal passage 130, via the flow path. When the valve stem 136 is not acted upon, it remains in a normally closed position so that pressurized gas remains sealed in the internal volume 129.

FIG. 3 also shows a set of external threads 116*a* formed in the outer surface of the neck 116. These outwardly directed threads 116 are sized and shaped to engage the sleeve 18 of the paintball gun 12 shown in FIG. 1, according to the second preferred embodiment of the present invention. This embodiment also employs an upper O-ring 152 to seal this connection with the sleeve 18. Thus, the second preferred embodiment of FIG. 3 differs slightly from the first preferred embodiment shown in FIG. 2. Nonetheless, with both preferred embodiments, the connection formed between the bottle 14 or 114 and the sleeve 18 is separate and independent from, i.e. it is isolated from, the internal connection of the bottle 14, 114 to the valve assembly. Also, with both embodiments the connection between the valve components and the bottle 14, 114 resides within the neck 16, 116, respectively. Thus, connection of the bottle 14, 114 and related components to the gun 12, or disconnection therefrom, will not cause the pressurized gas within internal volume 29, 129 to become suddenly and inadvertently opened to atmospheric pressure. In this respect, the present invention represents a significant and important safety improvement over conventional prior apparatus used for paintball activities.

Although this specification describes two preferred embodiments of the invention, it should be readily understood by those skilled in the art that these embodiments are exemplary. And they are meant to represent current preferred embodiments of the invention. Those skilled in the art will readily appreciate that a number of various modifications could be made to the specific structures shown and described herein, without departing from the scope of the invention. Thus, applicant intends to have the invention defined by the following claims, not the particular details of these preferred embodiments, and to have the following claims given the broadest reasonable interpretation in light of the disclosed embodiments and the rest of this specification.

I claim:

1. An apparatus comprising:

a paintball marker a pressure bottle removably connectable to the paintball marker via a first connection, the bottle including an internal volume and an internal passage extending through a neck of the bottle from the internal volume to an outlet;

a valve assembly removably held within the internal passage via a second connection, the valve assembly being structurally distinct from the first connection, and the first and second connections being operable such that connection of the pressure bottle to the paintball marker via the first connection and subsequent disconnection therefrom via the first connection occurs independently of the second connection between the valve assembly and the pressure bottle an access opening formed in the pressure bottle; and a burst disk fitted within the access opening, thereby to accommodate overpressure within the internal volume.

2. The apparatus of claim 1 wherein the first connection comprises a threaded connection.

3. The apparatus of claim 1 wherein the first connection comprises a mechanical engagement between an outer surface of the neck of the pressure bottle and the paintball marker.

4. The apparatus of claim 1 and further comprising:

a bonnet removably held within the internal passage adjacent the outlet, such that at least a portion of the valve assembly extends through the bonnet, the first connection comprising a mechanical engagement between an outer surface of the bonnet and the paintball marker.

5. A pressurized bottle for use in conjunction with a paintball marker, the bottle including an internal volume and an internal passage extending through a neck of the bottle from the internal volume to an outlet, comprising:

a valve assembly removably received within the internal passage via an internal connection, the valve assembly including a valve stem and a fluid flow path through which fluid flow is controlled by the valve stem; and a bonnet removably received within the internal passage and including a channel through which the valve stem extends, and further including an outer surface configured to mechanically engage a correspondingly shaped surface of the paintball marker, thereby to form a first connection therebetween, whereby connecting the pressurized bottle, the valve assembly, and the bonnet to the paintball marker via the first connection, and subsequent disconnection therefrom via the first connection occurs independently of the internal connection between the valve assembly and the pressure bottle;

an outer end located adjacent the bonnet when the valve assembly and the bonnet are connected within the central passage, the outer end sized and shaped so as to not be rotated by rotational movement of the bonnet, and also so as to be engageable for removal of the valve assembly from the internal passage.

6. The pressurized bottle of claim 5 wherein the internal connection is a threadable connection between the valve assembly and the pressurized bottle.

7. The pressurized bottle of claim 5 wherein the first connection comprises a threaded connection between an outer surface of the bonnet and a complementarily shaped surface of the paintball marker.

8. A pressurized bottle for use in conjunction with a paintball marker, the bottle including an internal volume and an internal passage extending through a neck of the bottle from the internal volume to an outlet comprising:

an annular adaptor residing in the internal passage;

a valve assembly retained radially within the adaptor;

an annular retainer also retained within the adaptor and holding the valve assembly in place within the neck; and a connector associated with the neck of the bottle and operable to connect to and disconnect from the paintball marker and to do so independently of the condition of the annular adaptor, the valve assembly, and the annular retainer relative to the bottle, wherein the annular adaptor is threadably received in the neck.

9. The pressurized bottle of claim 8wherein the connector further comprises:

external threads on an outer surface of the neck, thereby to accommodate a direct threadable connection of the bottle to the paintball marker.

10. The pressurized bottle of claim 8, wherein the valve assembly and the annular retainer are separately and independently connectable to the annular adaptor.

11. A pressurized bottle for use in conjunction with a paintball marker, the bottle including an internal volume and an internal passage extending through a neck of the bottle from the internal volume to an outlet comprising:

an annular adaptor residing in the internal passage;

a valve assembly retained radially within the adaptor;

an annular retainer also retained within the adaptor and holding the valve assembly in place within the neck; and a connector associated with the neck of the bottle and operable to connect to and disconnect from the paintball marker and to do so independently of the condition of the annular adaptor, the valve assembly, and the annular retainer relative to the bottle, wherein the valve assembly threads to the adaptor.

12. A pressurized bottle for use in conjunction with a paintball marker, the bottle including an internal volume and an internal passage extending through a neck of the bottle from the internal volume to an outlet comprising:

an annular adaptor residing in the internal passage;

a valve assembly retained radially within the adaptor;

an annular retainer also retained within the adaptor and holding the valve assembly in place within the neck; and a connector associated with the neck of the bottle and operable to connect to and disconnect from the paintball marker and to do so independently of the condition of the annular adaptor, the valve assembly, and the annular retainer relative to the bottle, wherein the annular retainer threadably connects to the adaptor.

* * * * *